US009185759B2

(12) United States Patent
Nieberlein et al.

(10) Patent No.: US 9,185,759 B2
(45) Date of Patent: Nov. 10, 2015

(54) LED LIGHTING DEVICE WITH LED PROFILE AND METHOD FOR OPERATING THE LED LIGHTING DEVICE

(71) Applicant: Diehl Aerospace GmbH, Ueberlingen (DE)

(72) Inventors: Uwe Nieberlein, Roth (DE); Stefan Dobler, Neunkirchen am Brand (DE); Jens Jordan, Nuremberg (DE)

(73) Assignee: DIEHL AEROSPACE, GMBH Uberlingen (DE)

( * ) Notice: Subject to any disclaimer, the term of this patent is extended or adjusted under 35 U.S.C. 154(b) by 4 days.

(21) Appl. No.: 13/851,546

(22) Filed: Mar. 27, 2013

(65) Prior Publication Data

US 2013/0257310 A1 Oct. 3, 2013

(51) Int. Cl.
*H05B 33/08* (2006.01)

(52) U.S. Cl.
CPC ..... *H05B 33/0821* (2013.01); *H05B 33/083* (2013.01)

(58) Field of Classification Search
CPC ..... H05B 33/083
USPC ..... 315/193
See application file for complete search history.

(56) References Cited

U.S. PATENT DOCUMENTS

| | | | | |
|---|---|---|---|---|
| 2010/0231135 | A1* | 9/2010 | Hum et al. | 315/250 |
| 2010/0308738 | A1* | 12/2010 | Shteynberg et al. | 315/185 R |
| 2011/0273103 | A1* | 11/2011 | Hong | 315/193 |
| 2012/0299490 | A1* | 11/2012 | Lee et al. | 315/191 |
| 2013/0015773 | A1* | 1/2013 | Tai et al. | 315/186 |

FOREIGN PATENT DOCUMENTS

DE 20 2011 105 404 U1 2/2012

* cited by examiner

*Primary Examiner* — Haissa Philogene
*Assistant Examiner* — Pedro C Fernandez
(74) *Attorney, Agent, or Firm* — Scully, Scott, Murphy & Presser, P.C.

(57) ABSTRACT

An LED lighting device for AC voltage supply is provided. The device has LEDs that form a whole chain. The LEDs are divided into LED part groups. The device also has multiple serial switching means, multiple shorting links and a control means. The control means is configured to control the shorting links and the serial switching means, to place the whole chain in at least two switch states. The switch states differ in the through voltage of the whole chain.

12 Claims, 7 Drawing Sheets

LED LIGHTING DEVICE WITH LED PROFILE AND METHOD FOR OPERATING THE LED LIGHTING DEVICE

BACKGROUND

The invention concerns an LED lighting device for an AC voltage supply, with several LEDs forming a whole chain, whereby the LEDs are divided into LED part groups, whereby a supply voltage with alternating amplitude is present in the LED lighting device.

LED lights are increasingly used for lighting rooms and suchlike, as they can realise a high optical yield with a simultaneously low energy requirement. If one compares LED lights with classic filament lamps it is clear that the operation of lights with a classic filament bulb with an alternating voltage supply is much simpler than that of LED lights. Whilst classic filament lamps can be supplied with alternating voltage without problem, whereby one needs only monitor the height of the alternating voltage, LED lights can be operated only within a very limited voltage range. With an LED light a minimum voltage must be exceeded on the one hand in order to make the LED light up, whilst too much current flows through the LED light if too high a voltage is applied on the other, so that the same will fail after a short period of time without active cooling.

The working window with regard to working voltage for supplying the LED light is therefore comparatively small. In particular it is not possible to connect an LED light directly to an alternating voltage supply, as an operation of the LED light is not possible due to the widely varying voltage values.

DE 20 2011 105 404 U1 lists various voltage supply possibilities for LEDs, whereby it is also pointed out that light-emitting diodes can be supplied from an alternating voltage source, whereby a bridge rectifier is located between the light-emitting diodes together with possible series resistors, so that the light-emitting diodes are supplied with a pulsating current.

SUMMARY

As part of the invention an LED lighting device designed for an alternating voltage supply is disclosed. An alternating voltage supply can for example consist of a public electricity network with an effective network voltage of 230 Volt and a network frequency of 50 Hertz. The alternating voltage supply preferably comprises an effective voltage of 115 Volt and a network frequency of between 400 Hertz and 800 Hertz, whereby such an alternating voltage supply can for example be provided on an aeroplane.

The LED lighting device comprises several LEDs (light-emitting diode), which form a whole chain. These several LEDs can for example be realised as white LEDs, red LEDs, green LEDs or blue LEDs, or as a mixture of the same. The whole chain represents an electric interconnection of several LEDs, whereby the whole chain is supplied with energy via a common, in particular bipolar connection. Inside this whole chain the several LEDs can be arranged electrically parallel, in series to each other, or in a mixed form.

The LEDs are organised or divided into LED part groups, whereby at least one LED is present in each LED part group. In the smallest embodiment of the invention exactly one LED is therefore located in each LED part group, whereby a preferred embodiment of the invention comprises a multitude of LEDs in each LED part group. The LEDs can be arranged electrically parallel or in series to each other or in a mixed form within the LED part group. Each LED part group also comprises its own, in particular bipolar connection with the energy supply. In particular all LEDs of the whole chain of the LED lighting device are divided into the LED part groups.

Due to the alternating voltage supply a supply voltage with alternating amplitude is applied. In one possible embodiment of the invention the LED lighting device comprises an optional mains filter, a rectifier and a PFC module, which together generate the supply voltage with alternating amplitude from the alternating voltage supply. In a special embodiment the supply voltage is designed as a rectified alternating voltage, in particular a rectified sinusoidal alternating voltage.

As part of the invention a particular switching of the LED part groups as well as their control is suggested:

The LED lighting device comprises several serial switching means, in particular formed as controllable disconnect switches, whereby a serial switching means and an LED part group together form an LED assembly. In particular each of the LED part groups comprises a serial switching means. The serial switching means is formed in the LED assembly in such a way that a current flow through the relevant LED part group is interruptible. In particular the serial switching means is arranged in series with the LED part group with regard to an input and an output of the LED assembly or with regard to two poles of the LED assembly. When the serial switching means is opened, the current flow through the LED part group and through the LED assembly is interrupted.

The LED lighting device comprises several LED assemblies switched in series—also known as switched in a row—so that an LED gap is formed, whereby the several LED assemblies form LED profiles of the LED gap. In the simplest embodiment of the invention with m MED assemblies, organised in an LED gap, an m×1 matrix is formed in this way. With further embodiments of the invention the whole chain comprises several LED gaps, in particular n LED gaps, so that an m×n (profiles×gaps) matrix is formed.

The arrangement of the LED assemblies in the respective matrix is in particular to be understood as a logical or electrical arrangement, where the LED assemblies can also be arranged matrix like in the actual spatial distribution, although they can also take on any other arrangement. In the latter case corresponding connection lines with the LED assemblies must be maintained.

The LED lighting device, in particular the whole chain, comprises several shorting links, whereby the LED gaps are each allocated to one of the shorting links, and whereby the shorting link is designed for bridging the LED assembly or assemblies in the LED profile.

The simplest embodiment of the invention as described above such a shorting link forms a by-ass to the LED assembly located in the relevant LED profile. In particular the serial switching means of the LED assembly is also bridged by the shorting link, and especially the by-pass. Where several LED gaps are envisaged all LED assemblies in the associated LED profile are bridged by a common shorting link.

The LED lighting device further comprises a control means for controlling the shorting links and the serial switching means in order to place the whole chain in at least two switch states, whereby the at least two switch states differ in the through voltage of the whole chain. In particular the volumes of the through voltages of the at least two switch states are greater than 1 Volt. The through voltage—also known as forward bias—is in particular understood as the threshold voltage that must be applied before the LEDs of the non-interrupted and not shorted LED part groups in the whole strand can light up.

It is one thought of the invention that the LED strand, and serial switching means of the whole chain, can or could comprise different through voltages depending on the operating condition of the LED shorting link. The LED lighting device in particular enables switching of several LED part groups in series or in a row in order to change the through voltage. If one for example switches two LED part groups with only one LED each with a forward bias of 3.4 Volt in series, the common through voltage will be 6.4 Volt. If one of the shorting links is activated, so that one of the LED assemblies is shorted, the through voltage will be 3.4 Volt. The possibility of changing the switch states of the whole chain therefore achieves that the through voltage of the whole chain can be adjusted.

The LED lighting device of the invention therefore makes it possible that the through voltage of the whole chain can be flexibly adjusted to suit the changing amplitude of the supply voltage. In this way it is possible that a part quantity of the LEDs can be operated within an acceptable working window, in particular with regard to the voltage height without letting losses due to series resistors become too great, and whilst another part quantity of the LEDs is switched off at least temporarily.

With one preferred embodiment of the invention the control means is designed to control the shorting links and the serial switching means in such a way that the switch state that has the highest through voltage is activated, whereby the through voltage is smaller than or equal to the current supply voltage. This means that the switch state that will make the best use of the through voltage is preferably always selected. With this method of operation an overheating of the LEDs due to high voltages is avoided and the LEDs are simultaneously operated within an energy efficient range.

With a particularly preferred switching technical realisation of the invention the control means is designed as a programmable, in particular digital data processing means. The control means can for example be realised as a micro-controller, DSP or FPGA. This realisation has the advantage that the complex control of the serial switching means and the shorting links can be flexibly adjusted by programming the data processing means.

With one preferred embodiment of the invention the control means is designed for random access to the serial switching means and the shorting links of the whole chain. The possibility of activating and deactivating the serial switching means and the shorting links independently from each other via the control means is thus provided. This embodiment of the invention has the advantage that a particularly high flexibility is possible during the selection of the serial switching means and the shorting links.

With one preferred embodiment of the invention the control means is designed for controlling the serial switching means and the shorting links in such a way that the whole chain can be placed into several variants of a switch state. The different variants of the switch state comprise the same through voltage of the whole chain, whilst the selection of the active, thus current flowed LED part groups is however different from one variant to the next. If one views all LED part groups as elements of a quantity as active LED part groups, then the elements form a (real) part quantity of the whole in a switch state. With one variant of the same switch state a second (real) part quantity of the quantity with active LED part groups is formed, whereby the first and the second part quantity are uneven.

The advantage of several variants of a switch state lies in that the control means can for example be designed in such a way that all or most of the LEDs of the whole chain can be or are activated for the same length in a preferred operating mode for an average period. A further advantage of the different variants is that LEDs can be activated in different positions, so that even lighting can be achieved even with a greater number of deactivated LEDs in the whole chain through using different variants for an average period. The variants can also be optionally supplemented in order to activate differently coloured LED part groups depending on a desired overall colour of the whole chain without changing the through voltage of the whole chain.

Particularly preferably the control means comprises a bus interface, in particular a network interface for digital communication via a network. In particular the bus interface is formed in such a way that a digital protocol message can be received. The control means is further designed to interpret the digital protocol message, and in particular to obtain or deduct a brightness value and/or a colour value from the protocol message. The control means is preferably designed to control the whole chain in such a way that the brightness value and/or the colour value are adjusted for the whole chain.

With a preferred embodiment of the invention each of the LED profiles comprises LED assemblies with different colours. In particular each of the LED profiles comprises at least one LED assembly with red, in particular only red LEDs, at least one LED assembly with green in particular only green LEDs, and at least one LED assembly with blue, in particular only blue LEDs. The lighting device is preferably designed to set a multitude of colours within an RGB spectrum, or to give the impression of a mixed colour within the RGB spectrum as a profile colour, by controlling the serial switching means of each LED profile, whereby the multitude of colours includes a pure colour red, a pure colour blue and a pure colour green as well as a red-free mixed colour blue/green, a green-free mixed colour red/blue, a blue-free mixed colour red/green and a mixed colour red/green/blue. In particular all LEDs of an LED colour of an LED profile can be selectively deactivated with the serial switching means.

Alternatively or in addition the LED gaps each comprise only LED assemblies and/or LEDs of a single colour. Particularly preferably each LED profile is limited to a single colour of the LED assemblies, in particular the LEDs. One LED gap will thus comprise only red LEDs and/or one LD gap only green LEDs and/or one LED gap only blue LEDs and/or one LED gap only while LEDs. Particularly preferably each single LED gap will comprise only LEDs of one colour. This design has the advantage that the LEDs or LED assemblies can be selectively activated or deactivated via the serial switching means of an LED gap without changing the overall colour of the LED gap or the whole chain, depending on the applied supply voltage of the LEDs.

The serial switching means and the shorting links are formed independent from each other and/or can be controlled independently from each other. In particular it is possible to deactivate each LED part group, and thus each LED of an LED profile, with one of the serial switching means independently from the shorting link, and therefore also when the shorting link is activated, i.e. when the LED profile is switched on.

Each of the red LEDs and/or green LEDs and/or blue LEDs preferably has a light yield of more than 60 Lumen/Watt, preferably more than 100 Lumen/Watt, in particular more than 120 Lumen/Watt. Particularly preferably the LEDs are designed as high performance LEDs. Particularly preferably the LEDs are designed for a current consumption during operation of more than 30 mA, in particular more than 50 mA, and especially more than 65 mA and/or the LED lighting device is designed to supply the activated LEDs with the said currents during operation.

With one preferred embodiment of the invention it is envisaged that the waveform of the supply voltage is formed by a repeating wave section. If the supply voltage is for example designed as a rectified sinusoidal alternating voltage, each wave section is designed as a sinusoidal half-wave. The at least two switch states are regularly taken up during one of the wave sections. With an increasing edge it is thus possible to regularly change from one switch state to another one of the switch states, whilst a decreasing edge of the wave section changes switch states in the opposite direction. This design emphasises that the adjustment of switch states is realised in a highly dynamic way, namely during the repeating wave section. In particular the adjustment of switch states is realised within a wave section. This does in particular not concern a static change of the switch state that would extend across several wave sections. In this way the whole chain is preferably adjusted on average by means of at least one, preferably at least two, and in particular at least four switching changes to suit the current value of the supply voltage during a wave section.

With a possible embodiment of the invention the whole chain comprises several such LED gaps with LED assemblies, whereby the LED gaps are arranged electrically parallel with each other, whereby the LED assembly of the LED gaps forms the LED profiles and whereby the shorting link associated with the LED profile is designed for bridging all LED assemblies of the LED profile. This design increases the possible number of LED assemblies and thus allows a scaling of the whole chain and the LED lighting device. In the simplest case the serial switching means of an LED profile can be controlled so that the whole chain is activated or deactivated depending on the LED profiles.

With one possible embodiment of the invention it can be envisaged that the LED profiles and/or the LED gaps and/or the LED part groups are of a different overall colour, so that an overall colour of the whole chain can be set by activating or deactivating the LED strands or the shorting links.

With one preferred embodiment of the invention the LED lighting device comprises a current sink switched in series (or in a row) with the whole chain. The supply voltage and a supply current are applied to the current sink. The current sink is designed for settling a chain current for the whole chain, so that the time curve of the supply current is synchronised with the time curve of the supply voltage or the time curve of a mains voltage of the AC voltage supply.

This embodiment of the invention is based on the thought that a very uneven current would flow through the whole chain through changing the switch states and the changing amplitude of the supply voltage without further measures. The current through the whole chain is once again known as a chain current here. Based on this irregular chain current one would firstly assume a similarly irregular mains current from the AC voltage supply, and secondly a very irregular brightness emitted by several LEDs. In order to reduce these effects the current sink ensures that the chain current is always selected in such a way that the supply current is optionally synchronised with the time curve of the supply voltage or the time curve of the mains voltage of the AC voltage supply. The said time curves can be included in the current sink as a reference variable. The current sink can for example comprise a controllable internal resistance, the size of which is calculated by means of the quotient of the differential voltage between supply voltage or mains voltage and the current through voltage of the whole chain, divided by the desired supply current. In particular the current sink is controlled or regulated in such a way that a performance factor of the LED lighting device remains high.

With one possible embodiment of the invention the control means is designed to close all shorting links during one activation period when the supply voltage is smaller than the smallest through voltage of the at least two switch states. In particular the control means is designed to control a closing of the shorting links at the start and the end of a wave section of the supply voltage. With this embodiment it can be ensured that the whole chain is bridged at the start and the end of each wave section for as long as the supply voltage is insufficiently high to light up the LEDs of the whole chain.

Optionally it can be envisaged that the supply current, i.e. chain current available thanks to the closed shorting links is destroyed by the current sink or transformed into heat in order to maintain the performance factor of the LED lighting device.

A further object of the invention concerns a method for operating the LED lighting device described previously, or according to one of the preceding claims, whereby the control means places the LED strand in one of the two switching positions depending on a current supply voltage.

BRIEF DESCRIPTION OF THE DRAWINGS

Further characteristics, advantages and effects of the invention result from the following description of preferred embodiments of the invention. The drawings show.

DETAILED DESCRIPTION OF EXEMPLARY EMBODIMENTS

Figure 1:
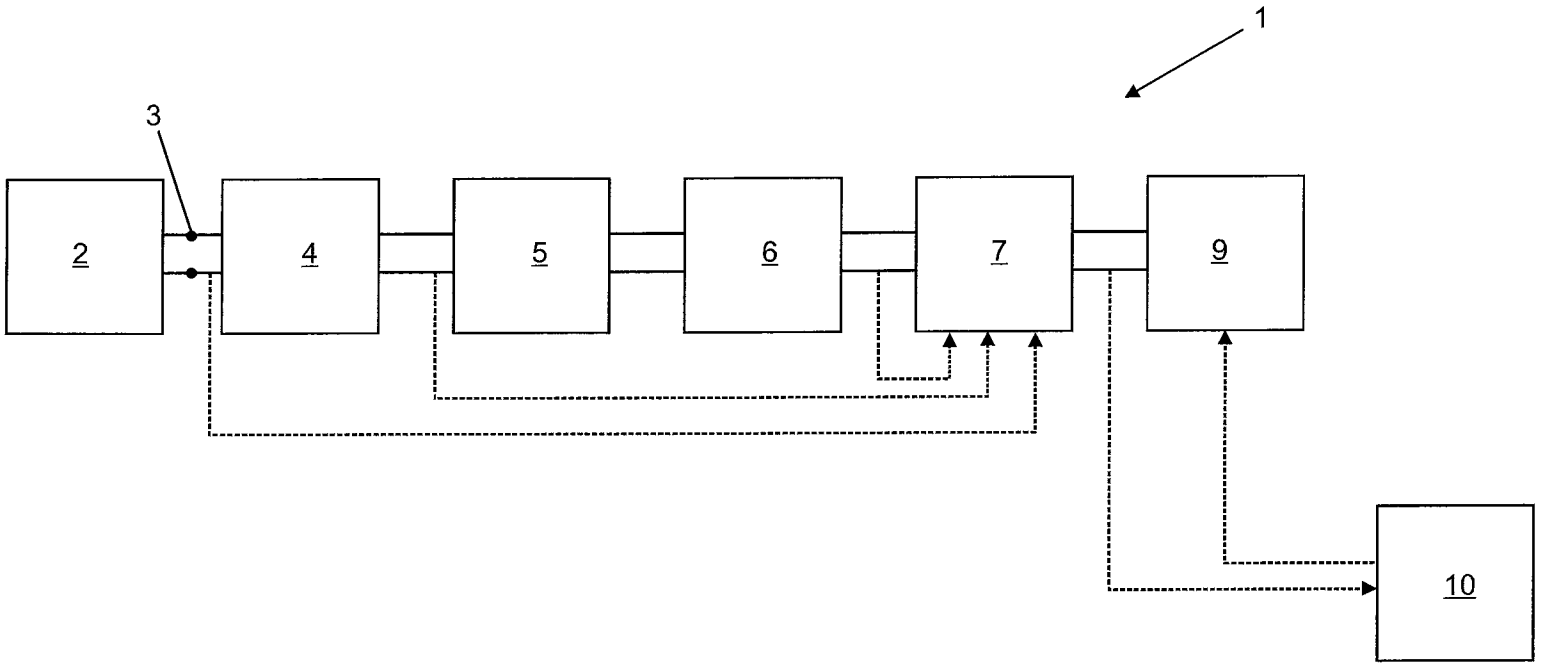
FIG. 1 shows a schematic block diagram of an LED lighting device as one embodiment of the invention.

FIG. 1 shows a schematic block diagram of an LED lighting device 1 designed for operation with an AC voltage supply 2. The LED lighting device 1 for example serves for lighting the interior of an airplane within the passenger cabin.

The LED lighting device 1 is connected to the AC voltage supply 2, from which it obtains mains voltage and a mains current. The input 3 of the LED lighting device 1 is followed by an optional mains filter 4, which is designed to filter interference which may be fed back to the AC voltage supply 2. In particular it concerns a low-pass filter, which is for example formed by switching condensers and inductivities.

The mains filter 4 is followed by a rectifier 5 designed for transforming the applied mains voltage, or the filtered mains voltage, into a rectified supply voltage. The rectifier 5 is for example designed as a bridge rectifier. The rectified supply voltage as well as the rectified supply current is transmitted to a PFC module 6 comprising a harmonic frequency filter or a performance factor correction filter as well as smoothing means such as for example a condenser. At least one switching element is located in the performance correction filter, so that the performance factor correction filter is designed as a cycled system or the combination of rectifier 5 and PFC module 6 designed as a switching power supply.

The PFC module 6 provides a supply voltage and a supply current, which are subsequently transferred to a current sink 7—also known as an electronic load. The current sink 7 is designed, regulated or controlled for destroying current and therefore performance by means of conversion into heat.

From the current sink 7 a chain voltage and a chain current are transmitted to an LED whole chain 9—also known as just a whole chain—with a multitude of LEDs.

The LED lighting device 1 further comprises a control means 10, which—as shown here—can be designed as a single component or as several components designed and is designed for controlling the LED whole chain 9.

The control means 10 receives the chain voltage, which also equals the supply voltage, as an input signal. Alternatively the control means 10 receives the supply voltage as the input signal. The control means 10 can for example be designed as a programmable micro-controller.

The LED whole chain 9 can be switched to different switch states with different variants via the control means 10, as is explained with reference to the FIGS. 2*a, b, c, d* as well as 3*a, b.*

Figure 2B:
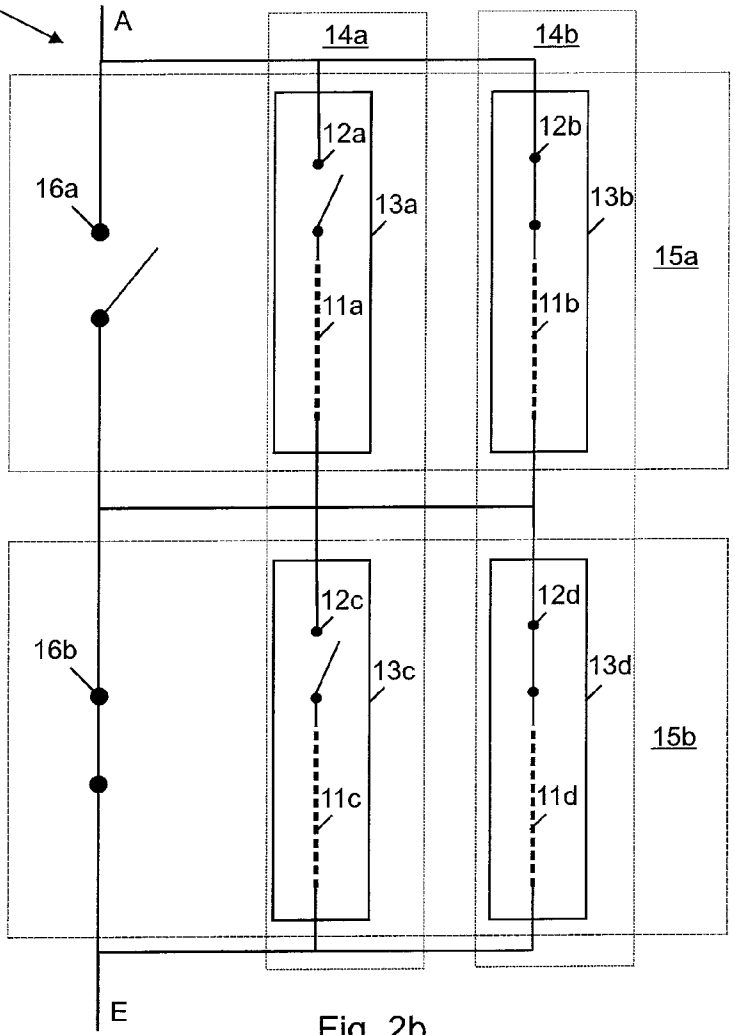
FIGS. 2*a, b, c, d* show a schematic illustration of a whole chain of LEDs of FIG. 1 in a switch state in four different variants.
Figure 2A:
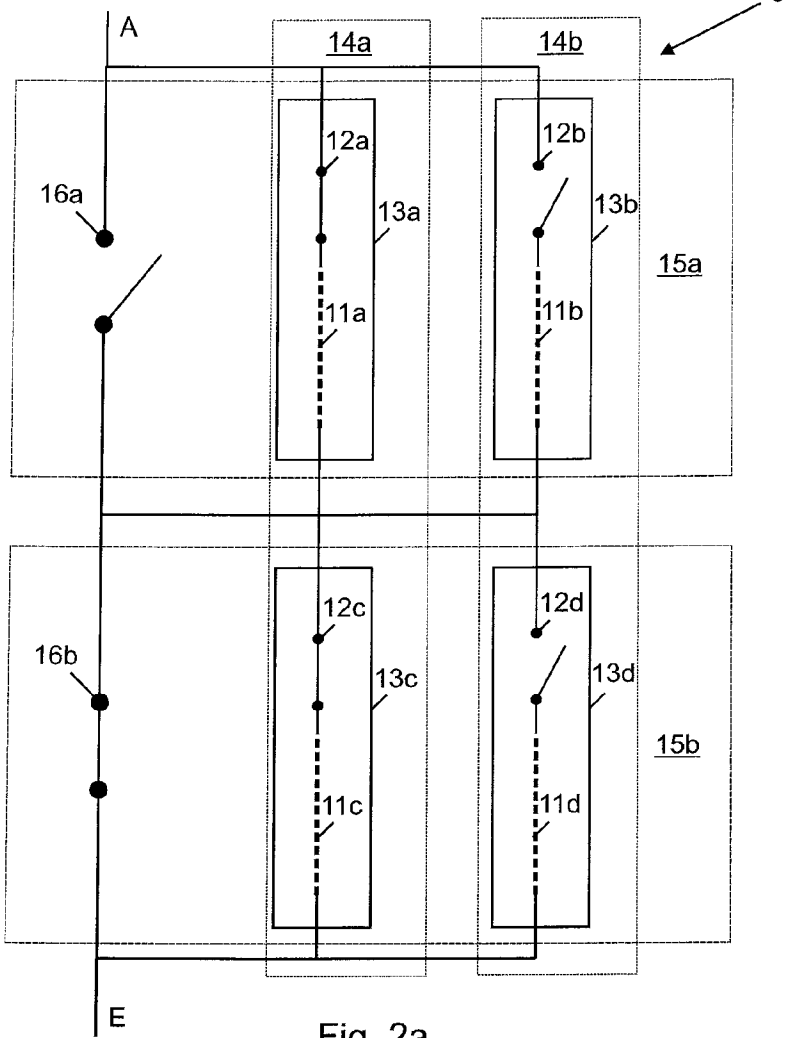

FIG. 2*a* shows the LED whole chain 9 as a first schematic illustration. The LED whole chain comprises an input E and an output A (or a first and a second pole), via which the LED whole chain 9 is connected to the voltage supply shown in FIG. 1.

In this example the LED whole chain 9 comprises four LED part groups 11*a, b, c, d*, whereby each LED part group 11*a, b, c, d* comprises at least one LED. In particular each LED part group 11*a, b, c, d* comprises the same through voltage (also called forward bias). The LED part groups 11*a, b, c, d* can—as is symbolically illustrated in the drawings—be switched in series (i.e. in a row) with each other in each LED part group 11*a, b, c, d*. In modified embodiment examples the LEDs can also be switched parallel, in series, or mixed parallel and in series with each other in the LED part groups 11*a, b, c, d.*

Each of the LED part groups 11*a, b, c, d* is allocated to a serial switching means 12*a, b, c, d*. The serial switching means 12*a, b, c, d* are arranged in series with the associated LED part group 11*a, b, c, d* in such a way that when a current flow through the associated LED part groups 11*a, b, c, d* is interrupted when the serial switching means 12*a, b, c, d* is opened. The LED part groups 11*a, b, c, d* each form an LED assembly 13*a, b, c, d* with the associated serial switching means 12*a, b, c d*. The LED assemblies 13 *a, b, c, d* are arranged in LED Gaps 14 *a, b* and are switched in series with each other here, whereby the LED assemblies 13 *a, c* are arranged in the LED profile 14*a*, and the LED assemblies 13*b, d* in the LED gap 14*b.*

The LED assemblies 13*a, b, c, d* are also arranged in LED profiles 15*a, b*, whereby the LED assemblies 13*a, b* are arranged in the LED profile 15*a*, and the LED assemblies 13*c, d* in the Led profile 15*b*. With regard to LED profiles 15*a, b* the LED assemblies 13*a, b, c, d* are switched electrically parallel with each other.

Each LED profile 15*a, b* is associated with a shorting link 16*a, b*, which enables shorting, bridging of or forming a by-pass for the associated LED profiles 15*a, b.*

The serial switching means 12*a, b, c*, d as well as the shorting links 15*a, b* can be switched via the control means 10. It is therefore possible to place the whole chain 9 in different switch states via the control means 10, whereby a switch state is defined by the through voltage—also known as forward bias—between input E and output A or between the two poles of the whole chain 9

In FIGS. 2*a, b, c, d* four different variant of a switch state I are shown. In FIG. 2*a* the switch state is designed in such a way that the through voltage of the LED whole chain 9 is formed by the through voltage of the LED part group 11*a*, as all other LED part groups 11 are deactivated either via the serial switching mean 12*b* for the LED part group 11*b*, or via the shorting link 15*b* for LED part group 11.

Figure 2D:
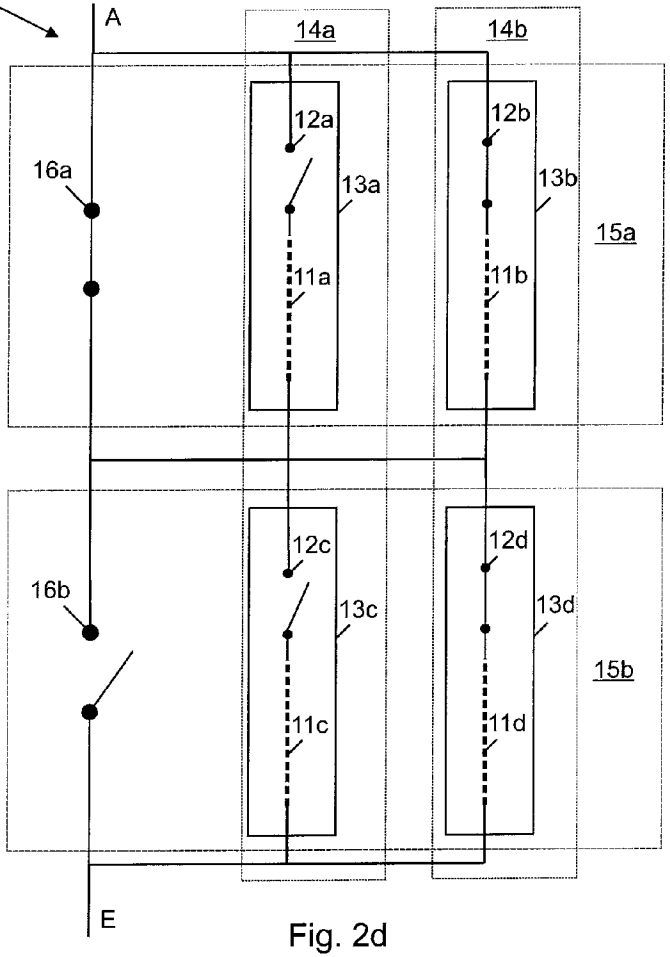
Figure 2C:
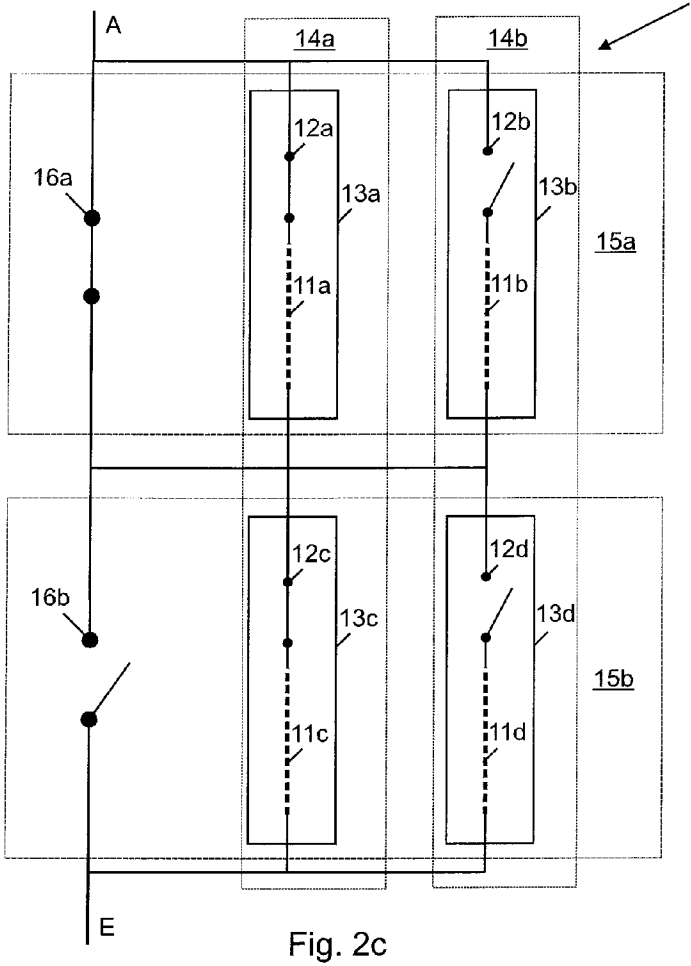

By changing the control only the LED part group 11*b* in FIG. 2*b*, only the LED part group 11*c* in FIG. 2*c*, and only the LED part group 11*d* in FIG. 2*d* are lit up. All variants of switch state I do however have the same through voltage, as the through voltages of LED assemblies 13*a, b, c, d* or LED part groups 11*a, b, c, d* are the same.

Figure 3B:
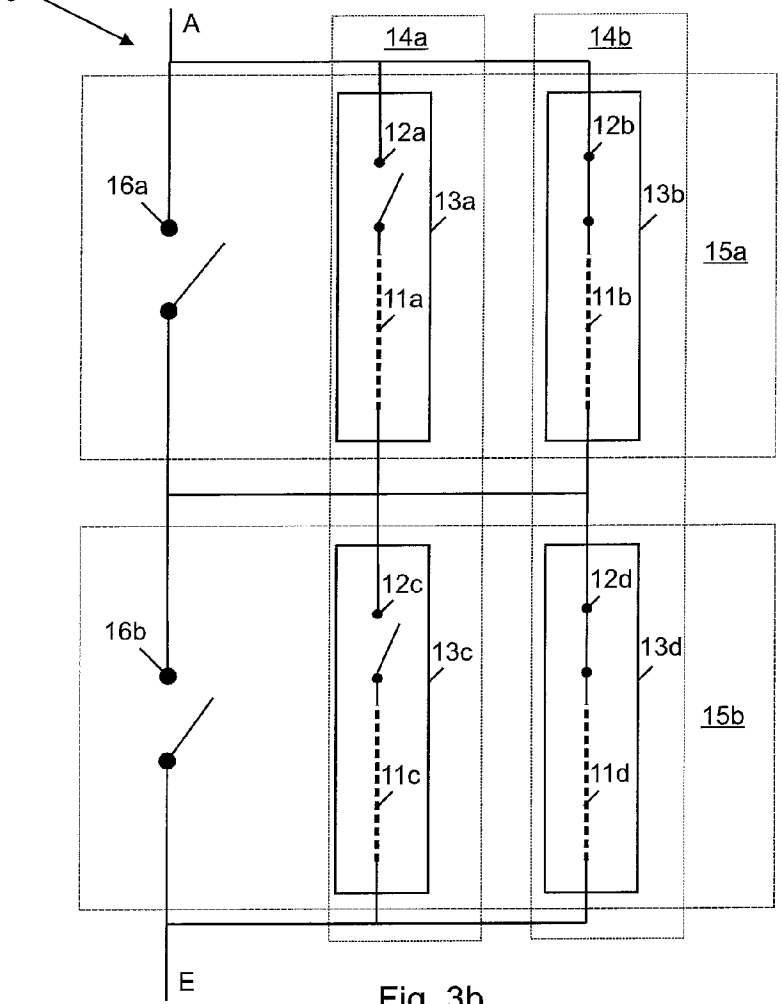
FIGS. 3*a, b* show a schematic illustration of the whole chain of the preceding drawings in a second switch state in two variants.
Figure 3A:
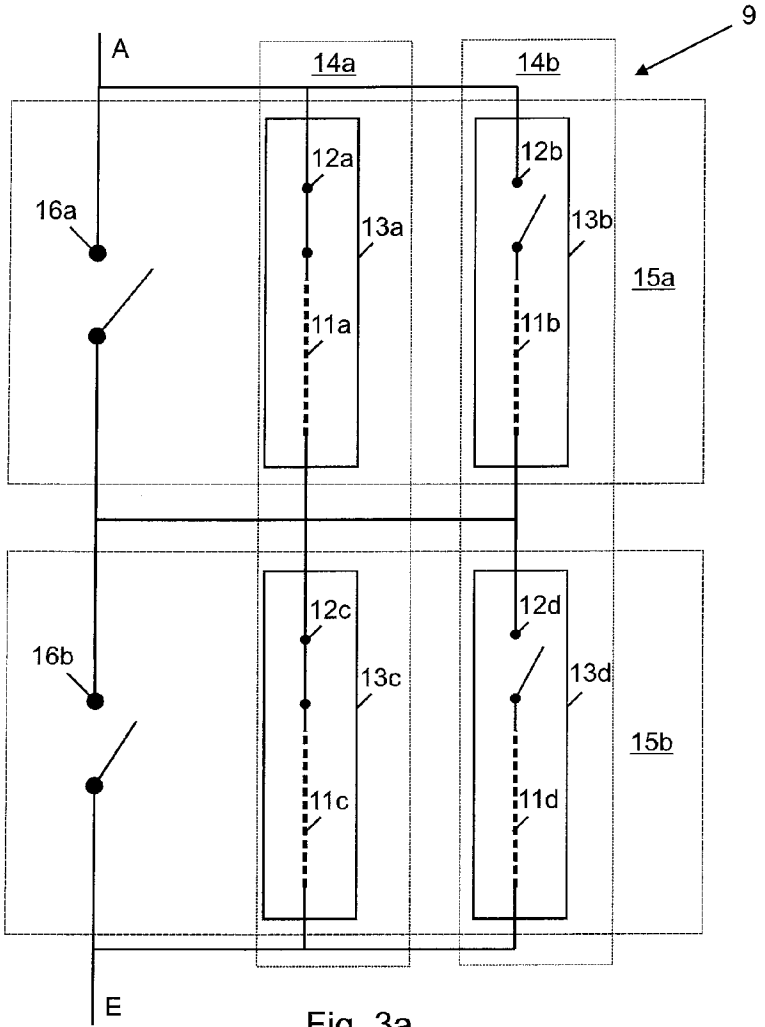

In FIGS. 3*a, b* the same LED whole chain 9 is shown in a switch state III, whereby the through voltage between input E and output A or the two poles equal the sum of the through voltages of the LEDs.

Assemblies 13*a, c* for the variant of FIG. 3*a* result in the sum of LED assemblies 1*b, d* for the variant of FIG. 3*b*. If one again assumes the same through voltages in the LED assemblies 13*a, b, c, d*, the through voltage in switch state II in FIGS. 3*a, d*, is twice as high as the through voltage of the LED whole chain 9 in FIGS. 2*a, b, c, d* in switch state III.

For each transition from one switch state I to a next switch state II or in the opposite direction the through voltage of the LED whole chain 9 is changed.

The control means 10 is designed for switching the whole chain 9 into the different switch states I and II as well as their variants. A corresponding control switch for this type of switching can for example be realised with the aid of diodes and transistors. It is also possible that the shorting links 15 *a, b* or the serial switching means 12*a, b, c, d* are controlled by means of control signals from the control means 10 designed as a micro-controller.

Figure 4:
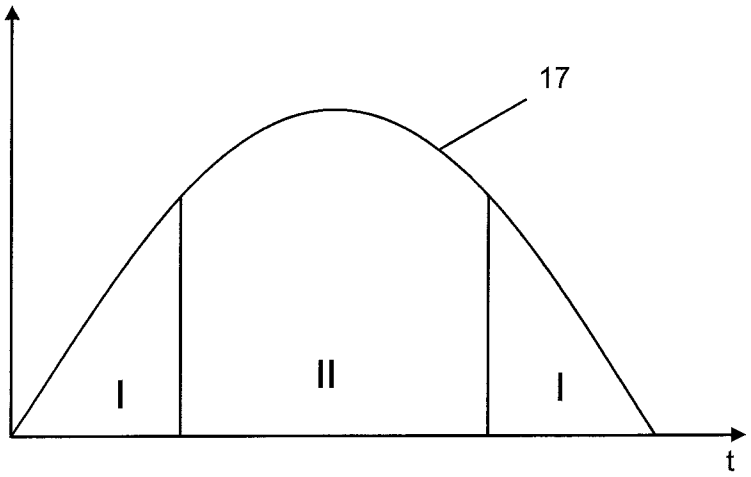
FIG. 4 shows a graph for illustration of the functionality of the LED lighting device of FIG. 1.

FIG. 4 shows a schematic graph of a half-wave 17 as a wave section of the chain voltage, which also equals the supply voltage. The X axis of the graph represents time t, whilst the Y axis represents the amplitude as any unit. The control means 10 received the chain voltage or a signal proportional to the same as an input signal. At the start of the half-wave 17 the LED whole chain 9 is switched to switch state I, so that the LED whole chain 9 comprises a first, low through voltage. In this way at least the LEDs of one of the LED part groups 11*a, b, c, d* can be lit with a comparatively low chain voltage. When the chain voltage increases, or when the same in particular exceeds the second through voltage of the LED whole chain 9 in switch state II, the control means 10 switches the LED whole chain 9 into the second switch state II. In this switch state the LEDs of the two LED part groups 11*a, b* or 11*c, d* will be lit.

On the falling edge of the half-wave 17 the process is repeated in reverse. By switching the LED whole chain 9 in the described way it is possible to adjust the through voltage of the LED whole chain 9 much better to the relevant current chain voltage of the half-wave 17, and thus to improve the degree of effectiveness and the lighting time of the LED whole chain 9.

In order to activate or LEDs in the LED part groups 11*a, b, c, d* on average for the same period, or to achieve an improved spatial distribution of the lit LEDs, the different variants of the switch states I and II are activated by the control means 10. In this way it can for example be envisaged that the variant shown in FIG. 2*a* is activated with a first half-wave, the variant shown in FIG. 2*b* activated in a second half-wave, the variant shown in FIG. 2*c* activated in a third half-wave, and the fourth variant shown in FIG. 2*d* activated in a fourth half-wave. In the same way the two variants of the switch state I can alternate. If the frequency of the AC voltage supply is sufficiently high the four LED part groups 11*a, b, c, d* of this distribution will be perceived as evenly lit by a human observer, as the rapid change is not visible to the human eye.

Although only four LED part groups 11*a, b, c, d* are illustrated in FIGS. 2*a, b, c, d*, or in 3*a, b*, the number of LED part groups can be chosen as desired. In this way it is possible that only two LED part groups are envisaged in the whole chain 9, although it is also possible that four, five or more LED part groups are present in the whole chain 9.

Figure 5:
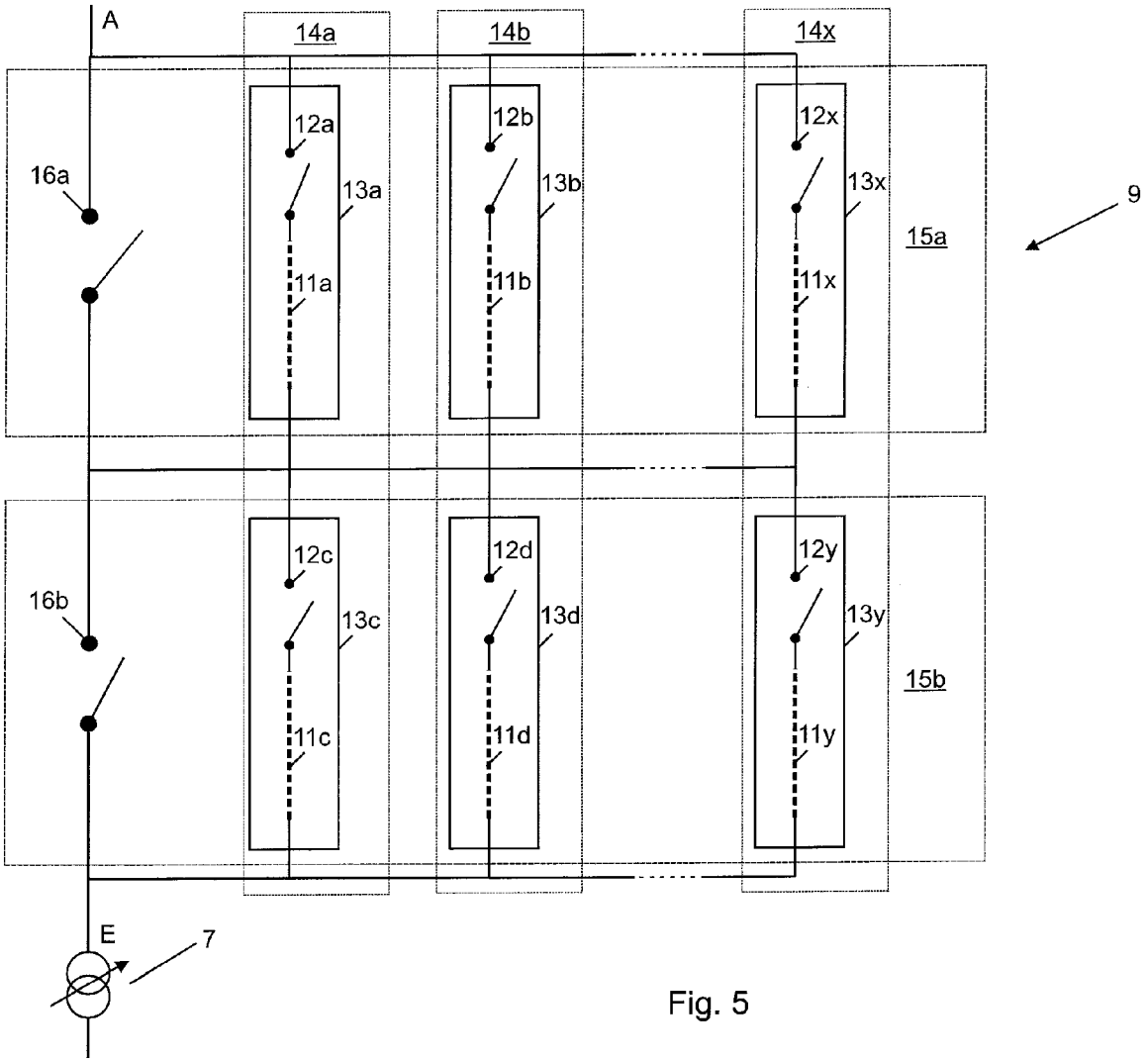
FIG. 5 shows a schematic illustration of a further embodiment example of a whole chain of LEDs of FIG. 1.

For clarification FIG. 5 shows a schematic illustration of a further LED whole chain 9, comprising several LED gaps 14 *a, b, x*, whereby still further LED gaps are possible, as is indicated by means of the dots. Each one of the LED gaps 14*a, b, x* of this embodiment example comprises two LED assemblies 13*a, b, c, d, x, y*, which profiles 15*a, b* in this example, whilst further LED profiles can be added in other embodiments. In this design it is also possible firstly to adjust the total through voltage between input E and output A of the whole chain 9 in the described way by activating or deactivating the shorting links 16*a, b, c* as well as the serial switching means 12*a, b, c, d, x, y* in the various LED gaps 14*a, b, x*

With one possible embodiment of the whole chain 9 the first LED gap 14*a* comprises only green LEDs, the second LED gap 14*b* only green LEDs, the third LED gap 14*x* only blue LEDs. Further LED gaps also comprise LEDs of only one colour.

The on or off switching of LED assemblies 13*a, b, c, d, x, y* switched in parallel also makes it possible to change the distribution of incoming power and/or the incoming chain current with the control means 10. In this embodiment it is thus possible that the control means 10 controls the LED whole chain 9 by controlling the shorting links 16 *a, b* in such a way that the same firstly comprises a through voltage that is adapted to suit the current chain voltage, and can secondly be controlled by switching LED assemblies 13*a, b, c, d, x, y* on and off via the serial switching means 12*a, b, c, d, x, y* to distribute the incoming current.

Figure 6:
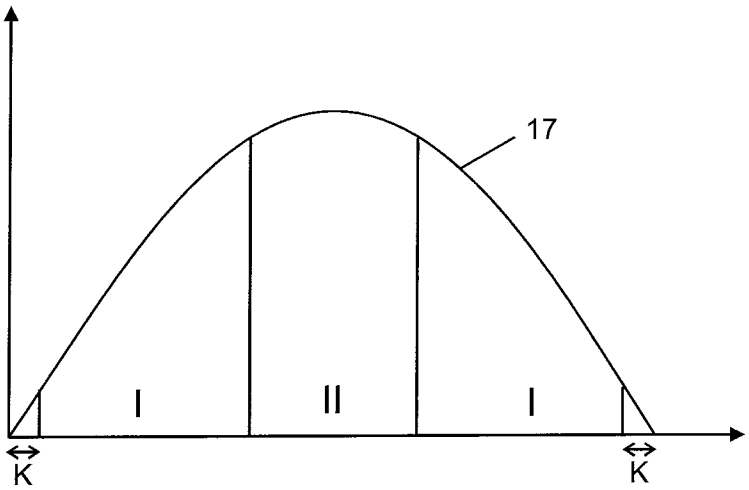
FIG. 6 shows a graph for illustration of the activation of the LED lighting device of FIG. 1.

FIG. 5 once again shows the current sink 7, which is designed as a controllable or regulatable current sink that is controlled with a sinus signal that is synchronous with the mains voltage or the filtered mains voltage or the supply voltage in this embodiment, so that the assemblies comprising the current sinks 7 and the LED whole chain 9 receives a chain current that is synchronous with the sinus signal. Due to the zero-voltage the supply voltage or chain voltage is lower at the start and the end of the half-wave 17 than the lowest through voltage of the LED whole chain 9 that can be set, as is schematically illustrated in FIG. 6. The control means 10 is designed to bridge the LED whole chain 9 at the start and the end of the half-wave 17 during an activation period K, during which the chain voltage is lower than the lowest through voltage of the switch states I, III. Bridging is realised in that the shorting links 16*a, b*, are closed. During this period the current sink 7 can allow the flow of chain current, so that the performance factor requirements of the LED lighting device 1 continue to be fulfilled.

LIST OF REFERENCE NUMBERS

1 LED lighting device
2 AC voltage supply
3 Input
4 Mains filter
5 Rectifier
6 PFC module
7 Current sink
8 Not assigned
9 LED whole chain
10 Control means
11*a, b, c, d, x, y* LED part group
12,*a, b, c, d, x, y* Serial switching means
13*a, b, c, d, x, y* LED assembly
14*a, b* LED gap
15, *a, b* LED profile
16*a, b* Shorting link
17 Half-wave
E Input
A Output
t

The invention claimed is:

1. An LED lighting device for AC voltage supply, the device comprising:

a plurality of LEDs forming a whole chain, wherein the plurality of LEDs are divided into a plurality of LED part groups wherein a supply voltage with changing amplitude is presented in the LED lighting device;

a plurality of serial switching means, wherein the LED part groups are each allocated to one of the plurality of serial switching means, wherein the associated LED part groups and serial switching means form an LED assembly, wherein the serial switching means are configured to interrupt a current flow in the associated LED part groups, and wherein two or more LED assemblies are switched in series to form an LED gap in a plurality of LED profiles;

a plurality of shorting links, wherein the plurality of LED profiles are each allocated to one of the shorting links, and wherein each shorting link is configured to bridge the LED assemblies in an associated LED profile; and a control means, wherein the control means is configured to control the shorting links and the serial switching means for placing the whole chain in at least two switch states, wherein the at least two switch states differ in the through voltage of the whole chain, wherein the device comprises a plurality of the LED gaps, the plurality of the LED gaps being arranged electrically parallel with each other such that the LED assemblies of the LED gaps form the LED profiles, wherein the shorting links allocated to each LED profile are configured to bridge all LED assemblies of the LED profile.

2. The LED lighting device according to claim 1, wherein the control means is configured to change the switch states in such a way that the switch state with the highest through voltage is activated, wherein the through voltage is lower than or equal to the supply voltage.

3. The LED lighting device according to claim 1, wherein the control means comprises a programmable data processing means.

4. The LED lighting device according to claim 1, wherein the control means is configured to randomly access the shorting links and the serial switching means.

5. The LED lighting device according to claim 1, wherein the control means is configured to control the serial switching means and the shorting links to place the whole chain in a plurality of variants of a switch state, wherein the variants comprise the same through voltage of the whole chain, but a different selection of deactivated LED assemblies.

6. The LED lighting device according to claim 1, wherein the waveform of the supply voltage is formed by a repeating wave section, wherein the different switch states are taken up during the wave section.

7. The LED lighting device according to claim 1, wherein at least one of the LED gaps, the LED profiles and the LED assemblies have different colours.

8. The LED lighting device according to claim 7, wherein each one of the LED profiles comprises LED assemblies with different colours, wherein each one of the LED profiles comprises at least one LED assembly with red, at least one LED assembly with green, and at least one LED assembly with blue.

9. The LED lighting device according to claim 1, wherein each one of the LED gaps comprises LED assemblies or LEDs of a common colour.

10. The LED lighting device according to claim 1, further comprising a current sink switched in series with the whole chain, to which the supply voltage and a supply current is applied, wherein the current sink is configured to control the chain current for the whole chain, so that the time curve of the supply current is synchronised with the time curve of the supply voltage or the time curve of a mains voltage of the AC voltage supply.

11. The LED lighting device according to claim 1, wherein the control means is configured to close all shorting links during an activation period, when the supply voltage is lower than the lowest through voltage of the different switch states.

12. A method for operating the LED lighting device according to claim 1, wherein the control means changes the switch state of the whole chain depending on the amplitude of the supply voltage.

* * * * *